US008225964B2

(12) United States Patent
Clark

(10) Patent No.: US 8,225,964 B2
(45) Date of Patent: Jul. 24, 2012

(54) SELF-LOCKING HANDHELD ADHESIVE DISPENSERS AND METHODS OF USING SUCH ADHESIVE DISPENSERS

(75) Inventor: Justin A. Clark, Sugar Hill, GA (US)

(73) Assignee: Nordson Corporation, Westlake, OH (US)

( * ) Notice: Subject to any disclaimer, the term of this patent is extended or adjusted under 35 U.S.C. 154(b) by 588 days.

(21) Appl. No.: 12/481,231

(22) Filed: Jun. 9, 2009

(65) Prior Publication Data

US 2009/0308892 A1 Dec. 17, 2009

Related U.S. Application Data

(60) Provisional application No. 61/061,243, filed on Jun. 13, 2008.

(51) Int. Cl.
*B67B 5/00* (2006.01)

(52) U.S. Cl. ..... 222/153.14; 222/1; 222/323; 222/473; 222/146.5

(58) Field of Classification Search ..... 222/323, 222/470, 472, 473, 153.14, 146.2, 146.5, 222/1; 251/89
See application file for complete search history.

(56) References Cited

U.S. PATENT DOCUMENTS

| | | | | |
|---|---|---|---|---|
| 3,543,968 | A | 12/1970 | Reighard et al. | |
| 3,971,492 | A * | 7/1976 | Lockwood | 222/146.5 |
| 4,166,579 | A * | 9/1979 | Beise et al. | 239/526 |
| 4,245,759 | A | 1/1981 | Baker et al. | |
| 6,431,468 | B1 * | 8/2002 | Brown et al. | 239/526 |
| 7,389,949 | B2 * | 6/2008 | Marchand et al. | 239/526 |
| 7,516,910 | B1 * | 4/2009 | DeWall et al. | 239/526 |

* cited by examiner

*Primary Examiner* — Kevin P Shaver
*Assistant Examiner* — Donnell Long
(74) *Attorney, Agent, or Firm* — Wood, Herron & Evans, LLP

(57) ABSTRACT

Self-locking handheld adhesive dispensers and methods for dispensing an adhesive using a handheld dispenser. The self-locking handheld dispenser includes a valve, a trigger connected to the valve, and a spring-biased trigger lock mechanism used to lock and unlock the trigger. A locking member of the trigger lock mechanism normally has a blocking relationship with the trigger that prevents an incidental force applied to the trigger from opening the valve. The trigger is unlocked by manually moving a locking member of the trigger lock mechanism out of the blocking relationship with the trigger. The trigger is then freed to respond to an applied manual force and open the valve to dispense the adhesive. When the trigger is released, the valve closes and the spring biasing of the trigger lock mechanism automatically returns the locking member to the blocking relationship with the trigger so that the locked state is restored.

18 Claims, 5 Drawing Sheets

SELF-LOCKING HANDHELD ADHESIVE DISPENSERS AND METHODS OF USING SUCH ADHESIVE DISPENSERS

CROSS-REFERENCE TO RELATED APPLICATIONS

This application claims the benefit of U.S. Provisional Application No. 61/061,243, filed Jun. 13, 2008, the disclosure of which is hereby incorporated by reference herein in its entirety.

BACKGROUND

The present invention relates to fluid dispensing, and more particularly to adhesive dispensers that are handheld and methods of operating handheld adhesive dispensers.

Handheld fluid dispensers are used in a wide variety of manufacturing applications. One typical application is dispensing a fluid material, such as a hot melt adhesive, between parts to be assembled manually. Typically, a worker will dispense a controlled amount of the hot melt adhesive from the handheld fluid dispenser onto a part, set the dispenser down, and manually contact the part with another part to initiate the formation of an adhesive bond. Then the worker will pick up the adhesive dispenser and repeat the process of adhesively bonding a new set of parts. One problem that arises with this procedure is accidental actuation of the dispenser when the worker is not holding or using the dispenser. In this instance, the worker must halt to clean up an adhesive spill.

To avert such adhesive spills, one conventional approach has been to install standard, manually-activated trigger locks on these handheld dispensers. The worker can place the manually-activated trigger lock in a locked condition before setting the dispenser down in anticipation of adhesively bonding a new set of parts. For a manufacturing application as described above, the dispenser is constantly being picked up or set down as the worker adhesively bonds different sets of parts. Current locking mechanisms require manual activation to activate and deactivate the trigger lock, which significantly decreases the efficiency of the overall manufacturing process.

There is thus a perceived need for a handheld fluid dispenser in which the trigger locking mechanism can be automatically actuated when a worker picks up the dispenser or sets down the dispenser.

SUMMARY

In one embodiment, a self-locking dispenser is provided for use in dispensing an adhesive upon application of a manual force. The self-locking dispenser includes a body with a fluid passage for the adhesive and a valve seat in the fluid passage. A valve, which is situated inside said body, has a valve element configured to move relative to the valve seat between a closed position in which the valve element contacts the valve seat to close the fluid passage and an opened position in which the valve element is separated from the valve seat to open the fluid passage. A trigger is mechanically coupled with the valve element of the valve. When the trigger is actuated by a first portion of the manual force, the trigger is configured to move the valve element relative to the valve seat from the closed position to the opened position. The self-locking dispenser further includes a trigger lock mechanism with a locking member and a handle. The handle is configured to receive a second portion of the manual force for moving the locking member relative to the trigger between a locked state that blocks movement of the trigger in response to receiving the first portion of the manual force and an unlocked state that permits movement of the trigger in response to receiving the first portion of the manual force. When the first portion of the manual force is released from the trigger, a biasing member is configured to apply a spring force to the trigger lock mechanism effective to return the locking member to the locked state.

In another embodiment, a method is provided for dispensing an adhesive using a dispenser having a valve and a trigger mechanically coupled with the valve. The method includes moving the trigger manually from a first position in which the valve is closed to a second position in which the valve is open for dispensing the adhesive from the dispenser. The method further includes releasing the trigger to permit the trigger to return to the first position and thereby close the valve. In response to releasing the trigger, the trigger is automatically locked in the first position without manual assistance.

DETAILED DESCRIPTION

Figure 1:
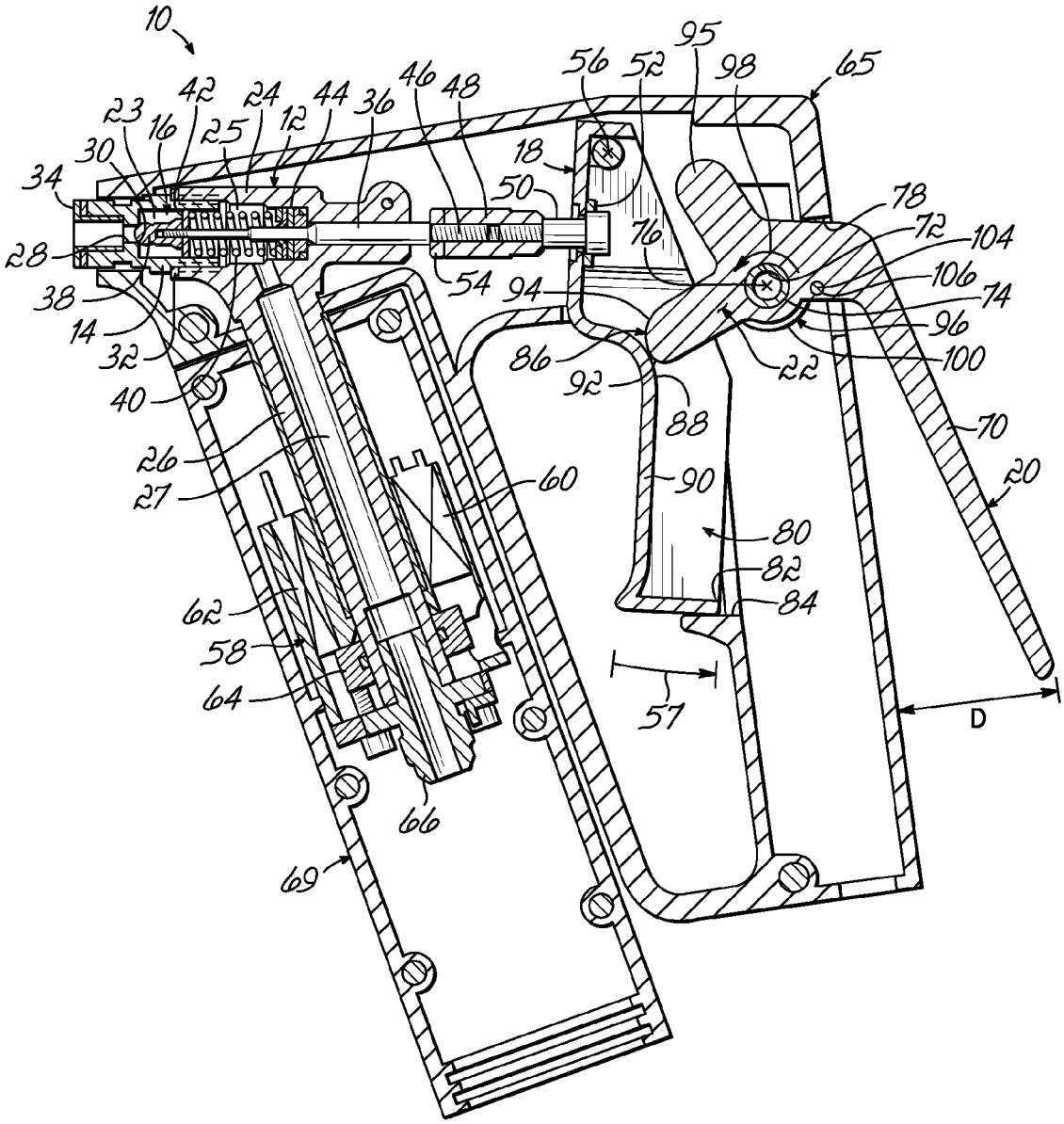
FIG. 1 is a front cross-sectional view of a self-locking handheld dispenser in accordance with one embodiment of the invention and in which the dispenser valve is in a functionally closed state with the trigger locked.

In the following description, in order to facilitate a thorough understanding of the invention and for purposes of explanation and not limitation, specific details are set forth, such as a particular geometry of the dispensing system and descriptions of various components. However, it should be understood that the invention may be practiced in other embodiments that depart from these specific details.

With reference to FIGS. 1-5 and in accordance with an embodiment of the invention, a self-locking handheld dispenser 10 comprises a body 12 that includes a valve seat member 14, a valve 16, a trigger 18 operatively connected with the valve 16, and a trigger lock mechanism 20 that includes a locking member 22 used to regulate the operation of the trigger 18. When the dispenser 10 is grasped and held by a user, a first portion of a manual force is applied to the trigger 18 and a second portion of a manual force is applied to the trigger lock mechanism 20 in order to operate the dispenser 10.

The body 12 includes an upper barrel section 24 with an axial bore 25 and a supporting post section 26 with an axial bore 27 that intersects the axial bore 25. An externally threaded rearward end of the valve seat member 14 is engaged with an internally threaded section of the axial bore 25. Extending through the valve seat member 14 is an axial bore 23 having a forward end defining a fluid outlet 28 from the self-locking handheld dispenser 10 and a rearward end of larger diameter. The interconnected axial bores 23, 25, 27 collectively define a fluid passage through the body 12. A valve seat 30 of the body 12 is defined inside the valve seat member 14 and within the fluid passage at the transition between bores 23, 25 as the inner rim of the shoulder at the junction of the different diameter sections of the axial bore 23. A ring seal 32 is compressed between the upper barrel section 24 of the body 12 and the valve seat member 14 to prevent leakage between the body 12 and the valve seat member 14. A nozzle 34 is coupled with the fluid outlet 28 exiting from the valve seat member 14.

The valve 16 includes a valve stem 36 configured for reciprocating motion relative to the body 12 and a valve element 38 carried at a forward end of the valve stem 36. As the valve stem 36 is moved, the valve element 38 provides a selective sealing engagement with the valve seat 30. A compression spring 40 is captured between a flange 42 on the valve stem 36 and the barrel section 24 of the body 12. The compression spring 40 biases the valve stem 36 in a direction that forces the valve element 38 into a contacting relationship with the valve seat 30. A circumferential seal 44 is provided between the valve stem 36 and the upper barrel section 24 of the body 12.

The valve stem 36 extends axially through the axial bore 25 in body 12 and has an externally threaded tip 46 at an end opposite to the end carrying the valve element 38. The threaded tip 46 mechanically attaches the valve stem 36 with an internally threaded trigger linkage 48. The trigger 18 is connected by the threaded shank of a shoulder bolt 50 with the linkage 48. A bearing plate 52 is located between the head of the shoulder bolt 50 and the trigger 18. The trigger 18 is pivotable about a pivot pin 56.

A manual force applied to the trigger 18 causes the trigger 18 to rotate in an arcuate path about the pivot pin 56, as indicated by the single headed arrow 57. The trigger 18 has a home position (FIG. 1) in which the valve 16 is unactuated or closed and the dispensing of adhesive is blocked and an activated position (FIG. 2) in which the valve 16 is actuated or opened with the valve element 38 in a non-contacting relationship with the valve seat 30. When the trigger lock mechanism 20 is in an unlocked condition, movement of the trigger 18 in the direction 57 by a manual force pulls the trigger linkage 48, bearing plate 52, and valve stem 36 as a unit rearwardly, which is opposed by the spring bias of the compression spring 40 as the trigger 18 moves from the home position to the activated position.

Figure 2:
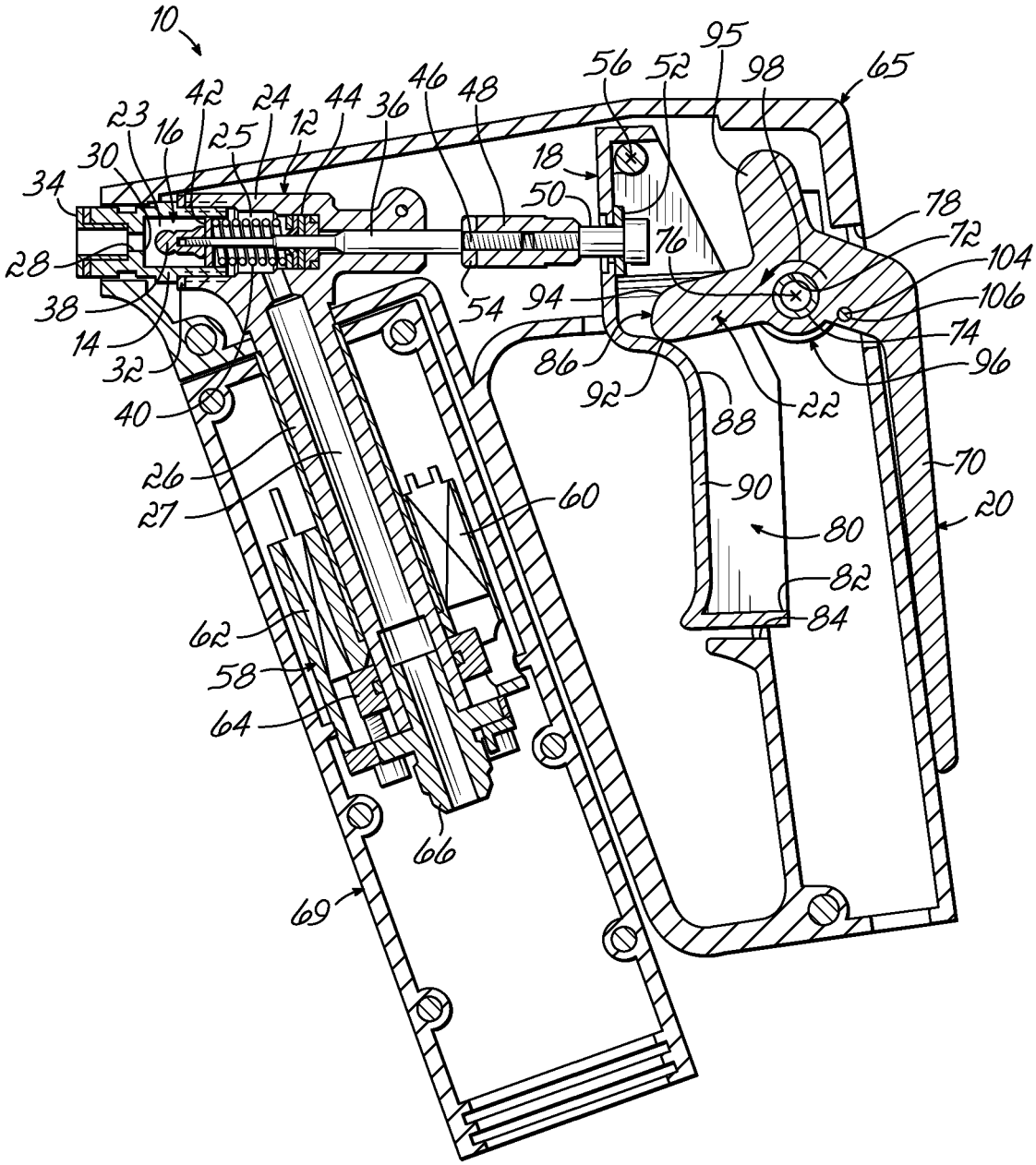
FIG. 2 is a front cross-sectional view similar to FIG. 1 in which the dispenser valve is in a functionally opened state to dispense adhesive with the trigger unlocked.
Figure 3:
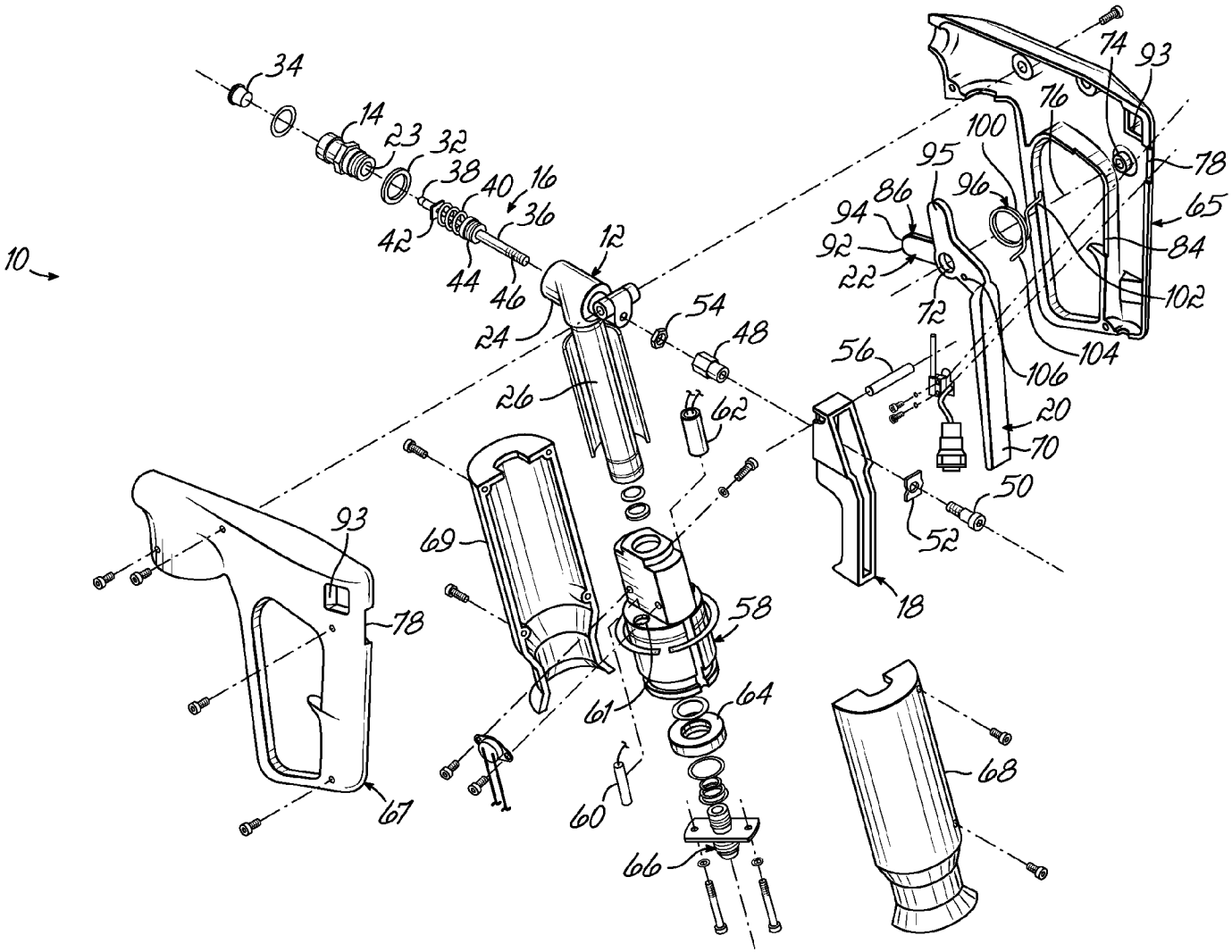
FIG. 3 is an exploded view of the self-locking handheld dispenser of FIG. 1.
Figure 4:
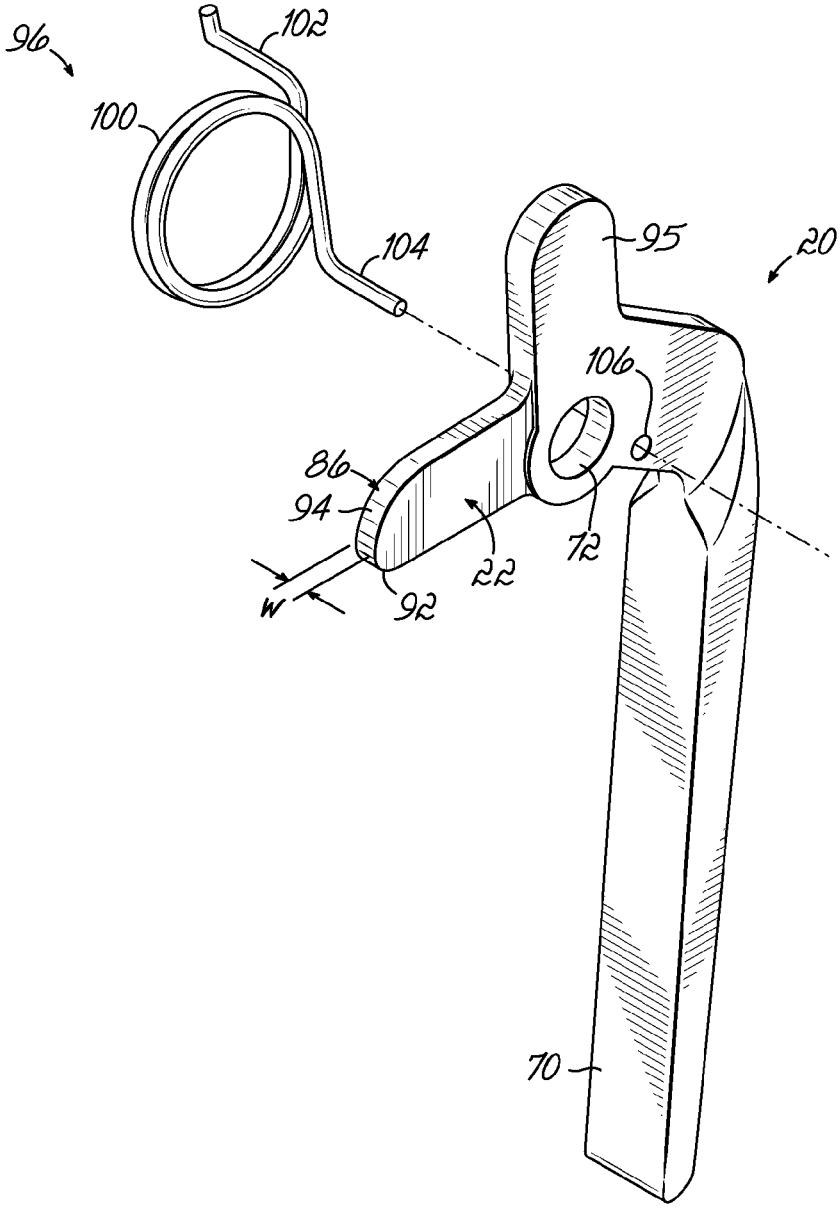
FIG. 4 is perspective view of an embodiment of a trigger lock mechanism for use in the self-locking handheld dispenser of FIG. 1.

Actuation of the trigger 18, as shown by the transition from the closed position of FIG. 1 to the opened position of FIG. 2, operates the valve 16 by moving the valve element 38 relative to the valve seat 30 from a closed position (FIG. 1) to an opened position (FIG. 2) for dispensing a pressurized adhesive, such as a hot melt adhesive. When the manual force is released from the trigger 18, the compression spring 40 moves the valve stem 36 of valve 16 so that the valve element 38 contacts the valve seat 30 to reestablish the closed position in which the adhesive is blocked from reaching the fluid outlet 28 and returns the trigger 18 to the home position. When the valve 16 is in its normally closed condition, the compression spring 40 maintains the valve element 38 in the contacting relationship with the valve seat 30.

The post section 26 of the body 12 is rotatably mounted within a pivot sleeve 58. Heat is supplied to the pivot sleeve 58 by a conventional electrical resistance heater 60 mounted within a bore 61 defined in the sleeve 58. The temperature of the pivot sleeve 58 is detected by a temperature sensor 62. Readings from the temperature sensor, which indirectly reflect the temperature of the adhesive in the axial bore 27 of the post section 26 of body 12, can be used by a temperature controller (not shown) to control the power supplied to the heater 60. As adhesive is dispensed from the fluid outlet 28, the axial bore 25 in the barrel section 24 is continuously replenished with pressurized adhesive flowing through the axial bore 27 in the pivot sleeve 34.

Located inside an axial bore of the pivot sleeve 58 is a thrust bearing 64 and bearing sleeve 54 that promote free rotation of the post section 26 of the body 12 relative to the pivot sleeve 58. The pivot sleeve 58 is bolted to the post section 26. Affixed to a lower end of the pivot sleeve 58 is a swivel connector 66, which is adapted to connect the axial bore 27 of the post section 26 of body 12 to a hose or external supply line (not shown) configured to convey a stream of adhesive from a source to the self-locking handheld dispenser 10, as well as wiring for electrical power and electrical signals.

The barrel section 24 of the body 12 and the valve seat member 14 are housed inside of a hollow shell or housing that includes a first shell half 65 and a second shell half 67 fastened with the first shell half 65. The shell halves 65, 67 include a trigger guard that defines a trigger space in which the exposed surfaces of the trigger 18 are substantially disposed. The trigger guard protects the exposed surfaces of the trigger 18 and the user's hand from inadvertent impacts during the hand-held operation of the self-locking handheld dispenser 10. Similarly, the post section 26 of the body 12 and the pivot sleeve 58 are housed inside a pair of shell halves 68, 69 that along with shell halves 65, 67 thermally insulate the hot portions of the dispenser 10 from the surrounding environment.

The trigger lock mechanism 20, which has a rotatable mounting between the shell halves 65, 67, includes a handle 70, a central boss-receiving aperture 72 that is engaged with the exterior of a cylindrical boss 74 of shell half 65 to define a pivot axis 76, and the locking member 22. The locking member 22 is located on an opposite side of the pivot axis 76 from the handle 70 such that the locking member 22 and handle 70 move synchronously as a unit about the pivot axis 76. A narrowed neck of the trigger lock mechanism 20 protrudes through a slot or opening 78 defined along the seam between the first and second shell halves 65, 67 so that the handle 70 is exterior of the body 12 and the pivotal connection about the pivot axis 76 is interior of the shell halves 65, 67. When a user applies a manual force of a sufficient magnitude to the handle 70 of the trigger lock mechanism 20, the handle 70 and locking member 22 collectively rotate in a clockwise rotational sense about the pivot axis 76 and relative to the body 12. The manual force applied to the handle 70 is unbalanced by other forces acting in the system, which causes the rotation of the trigger lock mechanism 20 to occur about the pivot axis 76.

Rotation of the trigger lock mechanism 20 about the pivot axis 76 controls the actuation of the trigger 18. When the trigger lock mechanism 20 is in a locked condition (FIG. 1; between L and RP in FIG. 6), the trigger 18 is physically blocked by the locking member 22 from actuating the valve 16. The trigger lock mechanism 20 has an unlocked condition (FIG. 2; L in FIG. 6) that releases the trigger 18 by placing the locking member 22 in a position that permits the trigger 18 to actuate the valve 16 to an opened position. Movement of the trigger lock mechanism 20 from the locked condition to the unlocked condition delays the reaction of the trigger 18 to the application of manual force. The trigger 18 cannot be actuated to open the valve 16 unless the trigger lock mechanism 20 is first released from the locked condition.

The locking member 22 has the form of a lobe that projects into a hollow interior 80 of the trigger 18 through a slot or opening 82 defined in a side edge of the trigger 18. The opening 82 in the trigger 18 is oriented to face toward a slot or opening 84 defined along the seam between the first and second shell halves 65, 67, and the openings 82, 84 are generally aligned with each other and have a greater width than the width, w, of the locking member 22. When the locking member 22 is rotated, the side surfaces of the locking member 22 clear the shell halves 65, 67 and the trigger 18 to permit the locking member 22 to freely move within the communicating openings 82, 84.

The convex tip of the locking member 22 has a contoured cam surface 86 configured to contact and engage a surface 88 of a contoured wall 90 of the trigger 18. The inner surface 88 of the contoured wall 90 is located in the hollow interior 80, which is enclosed by the contoured wall 90 but for the opening 82. In use, the outer surface of the wall 90 on the trigger 18 is contacted by the user's fingers from which the manual force is applied to the trigger 18.

Figure 5:
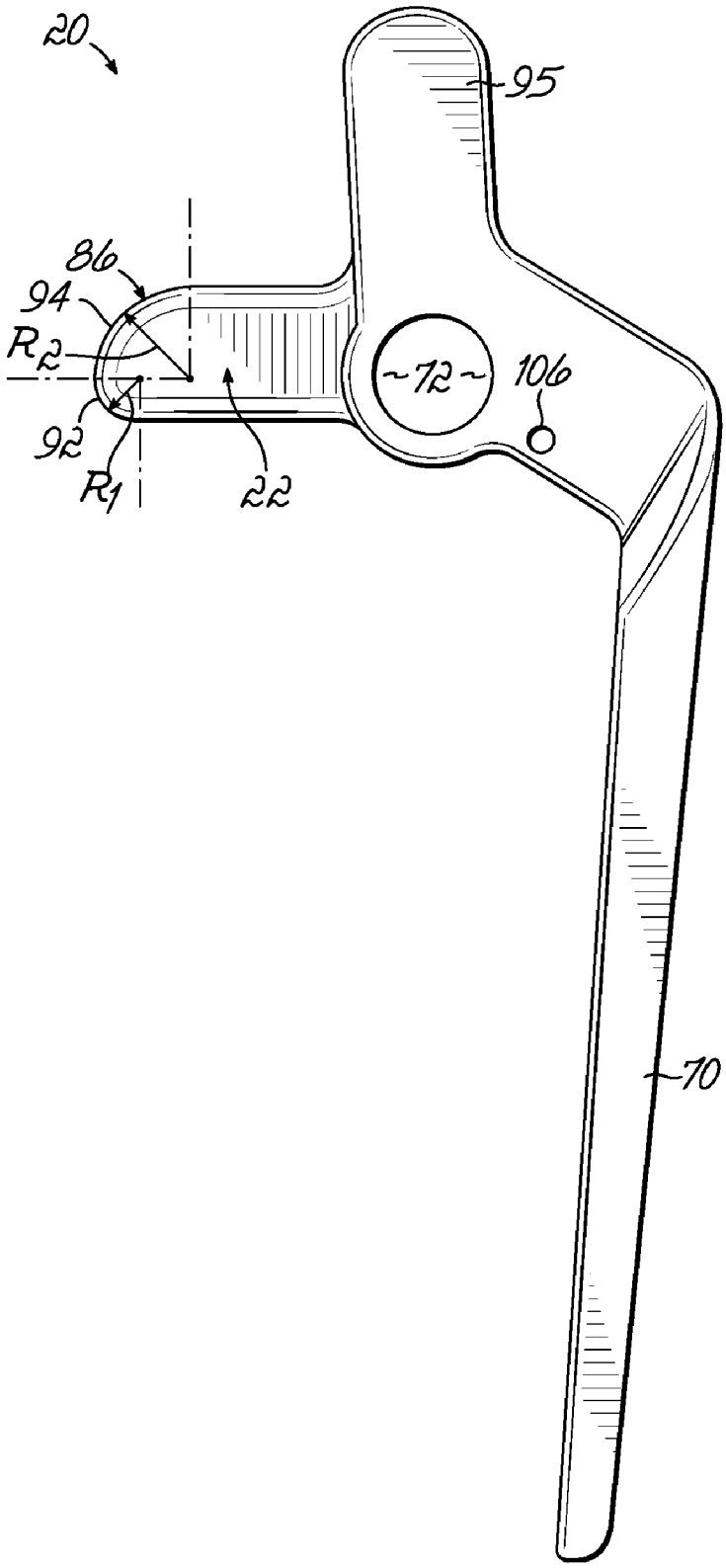
FIG. 5 is a side view of the trigger lock mechanism of FIG. 4.

A cam profile on the cam surface 86 is segmented into a first section 92 and a second section 94 differentiated from the first section 92 by a difference in the radius of curvature. The compound radius of curvature on the cam surface 86 is best shown in FIG. 5. The radius, $R_2$, of the second section 94 of the cam surface 86 is larger than the radius, $R_1$, of the first section 92 of the cam surface 86. In a representative embodiment, the first section 92 of the cam profile may have a radius of 0.150 inches and the second section 94 of the cam profile may have a larger radius of 0.326 inches. The compound radius of the cam surface 86 provides certain advantages, as described hereinbelow.

When the trigger lock mechanism 20 is in the locked condition (FIG. 1; L in FIG. 6) and a manual force is absent from the trigger 18 and handle 70, the second section 94 of the cam surface 86 on the locking member 22 contacts the surface 88 on the wall 90 of the trigger 18 and, while in this stationary state, blocks movement of the trigger 18. As the handle 70 of the trigger lock mechanism 20 is initially rotated by an applied force from a user's palm in a clockwise direction about the pivot axis 76, the second section 94 of the cam surface 86 on the locking member 22 rides along the surface 88 while maintaining a contacting relationship and maintaining the locked condition. This contacting relationship physically blocks movement of the trigger 18 so that the valve 16 remains dormant and inactive. As the trigger lock mechanism 20 rotates, this contacting relationship continuously locks the trigger 18. The configuration of the second section 94 of the cam surface 86 solves the problem of the valve 16 being partially opening as the trigger 18 is depressed.

As the trigger lock mechanism 20 further rotates about the pivot axis 76, the second section 94 of larger radius, $R_2$, on the cam surface 86 transitions (T in FIG. 6) to the first section 92 of smaller radius, $R_1$, which maintains contact with the surface 88 of the wall 90 and thereby maintains the locking member 22 in the locked condition. The smaller radius of the first section 92 permits the locking member 22 of the trigger lock mechanism 20 to rotate with an increased angular velocity in comparison with the second section 94. The increased angular velocity arises from the angular acceleration arising from the decrease in the radius of rotation of the trigger lock mechanism 20. The trigger 18 moves a small amount over this interval of rotation of the locking member 22.

As rotation of the locking member 22 continues, a release point (RP in FIG. 6) is reached on the cam surface 86 that initiates the opening of the valve 16 by the trigger 18. When the cam surface 86 is entirely out of the path of the trigger 18, the trigger 18 is freed to rotate in the arcuate path 57 about the pivot axis 56 and the valve 16 is actuated by the trigger 18. The locking member 22 slides across the surface 88 on the wall 90 as the trigger 18 actuates the valve 16. When the valve 16 is open, the locking member 22 is located above the inner surface 88 on the wall 90 in an unlocked condition (FIG. 2; UL in FIG. 6) with either a mutually contacting or non-contacting relationship so that the blocking force is not applied to the trigger 18.

When the second section 94 of the cam surface 86 contacts the surface 88 on the wall 90 of the trigger 18, the locking member 22 is in the locked condition and the locking member 22 has an acceptable throw, D, for the trigger lock mechanism 20 in moving from the locked condition to the unlocked condition. This acceptable throw, D, is adapted to be within a normal gripping distance for a user's hand, as defined by the separation between the fingertips and the base of a palm in a gripping position. A user of the dispenser 10 is able to normally grip the dispenser 10 by placing one or more fingers on trigger 18 while the user's palm is contacting the handle 70 of the trigger lock mechanism 20 in the position shown in FIG. 1.

The trigger lock mechanism 20 includes an arm 95 that projects outwardly from the pivot axis 76. The arm 95 is visible through a window 93 formed in the first and second shell halves 65, 67 when the trigger lock mechanism 20 is activated. When the trigger lock mechanism 20 is locked, the arm 95 does not block the window 93 and an active restraining device, such as the shackle of a padlock (not shown), can be inserted through the window 93 to physically block movement of the trigger lock mechanism 20 from the locked condition. In order to use the dispenser 10, the locking mechanism of the padlock must be unlocked to free the shackle and the shackle of the padlock must be physically removed from the window 93 so that the trigger lock mechanism 20 is capable of rotation in order to free the trigger 18 to respond to an applied manual force and thereby actuate the valve 16.

A biasing member 96 biases the trigger lock mechanism 20 relative to the shell halves 65, 67 and the cylindrical boss 74. In the absence of pressure applied to the trigger lock mechanism 20, the biasing member 96 urges the locking member 22 toward the locked condition that blocks actuation of trigger 18. To that end, the biasing member 96 applies a spring force in the counterclockwise direction, as shown by arrow 98, about the pivot axis 76. The spring force from the biasing member 86 opposes movement of the locking member 22 in the clockwise rotation sense, but is designed to yield when exceeded by the magnitude of the manual force applied to the trigger lock mechanism 20. A person having ordinary skill in the art will appreciate that the clockwise/counterclockwise directional senses for the forces and rotations is not limiting.

The manual force required to exceed the spring force is approximately a normal gripping force so that the locking member 22 rotates whenever the dispenser 10 is picked up by a user and the handle 70 of the trigger lock mechanism 20 and trigger 19 are actively gripped in a normal fashion. When the pressure is released from the trigger 18 and the handle 70 of the trigger lock mechanism 20, the spring force from the biasing member 96 automatically returns the trigger 18 and trigger lock mechanism 20 to the locked condition shown in FIG. 1. This automatic return that locks the trigger 18 is accomplished without any active user interaction with the trigger lock mechanism 20.

In the representative embodiment, the biasing member 96 is a torsion spring coupling the trigger lock mechanism 20 with the boss 74 projecting interiorly of shell half 65. The torsion spring constituting the biasing member 96 operates by torsion or twisting with the exerted amount of spring force or torque proportional to the amount of twisting. The biasing member 96 is a metal rod or wire bent into a coil 100 with opposite ends 102, 104. The coil 100 is twisted about its axis by sideways forces (bending moments) applied to its ends 102, 104, which originate from the force applied to the handle 70. One end 102 of the biasing member 96 contacts a surface inside the window 93 and the other end 104 of the biasing member 96 is inserted into an aperture 106 in the trigger lock mechanism 20. The aperture 106 is located between the handle 70 and the pivot axis 76. In alternative embodiments, the aperture 106 may be replaced by a different type of mechanical restraint, such as a recess or a groove. As trigger lock mechanism 20 opposite to direction 98, end 104 moves relative to end 102 in order to provide the bending moments that twist the coil 100. As the coil 100 twists, the spring force applied to the trigger lock mechanism 20 increases. When the trigger 18 is released, the spring force from the biasing member 96 restores the trigger lock mechanism 20 to its locked state.

Figure 6:
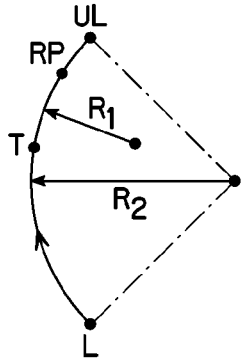
FIG. 6 is a diagrammatic view showing the motion of the locking member of the trigger lock mechanism of FIGS. 4 and 5.

In use and with reference to FIGS. 1-5, the self-locking handheld dispenser 10 is initially in the state shown in FIG. 1 with the trigger lock mechanism 22 in a locked condition (position L in FIG. 6). A user grasps the self-locking handheld dispenser 10 with the palm on the handle 70 of the trigger lock mechanism 20 and one or more fingers resting on the trigger 18. When the user squeezes his grip, the fingers apply a manual force to the trigger 18 and the palm applies a manual force to the handle 70 of the trigger lock mechanism 20. The manual force applied to the handle 70 overcomes the spring force applied by the biasing member 96 to the trigger lock mechanism 20. This force imbalance causes rotation of the locking member 22 and handle 70 of trigger lock mechanism 20 about the pivot axis 76 (from position L toward position RP in FIG. 6).

The second section 94 of the cam surface 86 on the locking member 22 moves in contact with the surface 88 of the wall 90 over a first arc between positions L and T in FIG. 6 so that motion of the trigger 18 is continuously blocked by the physical presence of the locking member 22. Eventually, the first section 92 of the cam surface 86 contacts (T in FIG. 6) and moves in contact (in a second arc between positions T and RP in FIG. 6) with the surface 88 of the wall 90. The trigger lock mechanism 20 and locking member 22 are in the locked condition over the entirety of the first and second arcs. As the trigger lock mechanism 20 and locking member 22 further rotate, the release point (position RP in FIG. 6) is reached at which the first section 92 loses contact with the surface 88. This initiates the opening of the valve 16 by the trigger 18 as the trigger lock mechanism 20 and locking member 22 quickly rotate out of the path of the trigger 18. When rotation is complete, the trigger lock mechanism 20 and locking member 22 are in the unlocked condition (position UL in FIG. 6; FIG. 2) and the trigger 18 is permitted to actuate the valve 16.

The user maintains the pressure or force on at least the trigger 18 and optionally the trigger lock mechanism 20 to dispense the adhesive with the actuated valve 16. When the user releases the first force to discontinue dispensing of the adhesive, the trigger lock mechanism 20 activates to automatically lock the trigger 18 without user intervention. To that end, the biasing member 96 applies a spring bias in the direction 98 that restores the trigger lock mechanism 20 to a locked condition (position L in FIG. 6; FIG. 1) in which the locking member 22 is in a blocking relationship with the trigger 18.

As the user picks up and puts down the dispenser 10, the trigger 18 of the dispenser 10 is locked and unlocked with no additional force or input required. The automatic nature of the trigger locking minimizes accidental actuation of the trigger 18 and reduces inadvertent adhesive spills when using the self-locking handheld dispenser 10.

The automatic trigger-locking mechanism of the various embodiments of the invention may be used, for example, in various different types of handheld dispensers such as the handheld dispenser described in U.S. Pat. No. 4,245,759, which is hereby incorporated by reference herein in its entirety.

While the present invention has been illustrated by a description of various embodiments and while these embodiments have been described in considerable detail, it is not the intention of the applicants to restrict or in any way limit the scope of the appended claims to such detail. Additional advantages and modifications will readily appear to those skilled in the art. Thus, the invention in its broader aspects is therefore not limited to the specific details, representative apparatus and method, and illustrative examples shown and described. Accordingly, departures may be made from such details without departing from the spirit or scope of applicants' general inventive concept.

What is claimed is:

1. A self-locking handheld dispenser for use in dispensing an adhesive upon application of a manual force, the self-locking handheld dispenser comprising:

a body including a fluid passage for the adhesive and a valve seat in said fluid passage;

a valve inside said body, said valve having a valve element configured to move relative to said valve seat between a closed position in which said valve element contacts said valve seat to close said fluid passage and an opened position in which said valve element is separated from said valve seat to open said fluid passage;

a trigger mechanically coupled with said valve element of said valve, said trigger configured to move said valve element relative to said valve seat from the closed position to the opened position when said trigger is actuated by a first portion of the manual force;

a trigger lock mechanism including a locking member and a handle, said handle configured to receive a second portion of the manual force for moving the locking member relative to said trigger between a locked state that blocks movement of said trigger in response to receiving the first portion of the manual force and an unlocked state that permits movement of said trigger in response to receiving the first portion of the manual force;

a biasing member configured to apply a spring force to said trigger lock mechanism effective to return said locking member to said locked state when the manual force is released;

wherein said locking member and said handle of said trigger lock mechanism are configured to rotate about a pivot axis when said handle receives the second portion of the manual force;

wherein said locking member includes a cam surface having a contacting relationship with said trigger to provide the locked state and thereby block movement of said trigger when the second portion of the manual force is absent from said handle;

wherein said cam surface has a cam profile with a first section that is configured to maintain the contacting relationship with said trigger and thereby block movement of said trigger as said locking member rotates about said pivot axis over a first angular arc in response to said handle receiving the second portion of the manual force;

wherein said cam surface includes a second section configured to permit said locking member to rotate with an increased angular velocity in comparison with the first section over a second arc about the pivot axis while continuing to maintain the contacting relationship with said trigger and thereby block movement of said trigger; and wherein said first section is a first curved surface, and said second surface is a second curved surface having a smaller radius of curvature than said first curved surface.

2. The self-locking handheld dispenser of claim 1 wherein said cam surface includes a release point that provides the unlocked condition and releases the contacting relationship with said trigger such that said trigger moves said valve element relative to said valve seat from the closed position to the opened position.

3. The self-locking handheld dispenser of claim 2 wherein said second section is arranged on said cam profile between said first section and said release point.

4. The self-locking handheld dispenser of claim 1 wherein said locking member and said handle are located on opposite sides of said pivot axis.

5. The self-locking handheld dispenser of claim 1 wherein said trigger lock mechanism includes an opening, and further comprising:

a housing enclosing said body and including a boss engaged with said opening to define a pivot axis about which said trigger lock mechanism is rotatable to place said locking member in the locked and unlocked conditions.

6. The self-locking handheld dispenser of claim 5 wherein said biasing member is a torsion spring associated with said boss, said torsion spring including a first end mechanically connected with said housing, a second end mechanically connected with said trigger lock mechanism, and a coil between said first and second ends.

7. The self-locking handheld dispenser of claim 1 wherein said handle is located exterior of said body and said locking member is located interior of said body.

8. The self-locking handheld dispenser of claim 1 wherein said biasing member is configured to yield when the second portion of the manual force applied to said handle is sufficient to overcome the spring force such that said locking member can move from said locked condition to said unlocked condition.

9. A method of dispensing an adhesive using a dispenser having a valve, a trigger mechanically coupled with the valve, and a trigger lock mechanism having a locking member for selectively blocking movement of the trigger and a handle for moving the locking member, the locking member including a cam surface having a cam profile with a first section and a second section, the first section having a first curved surface and the second section having a second curved surface with a smaller radius of curvature than the first curved surface, the method comprising:

unlocking the trigger by rotating the handle so the first section of the locking member contacts the trigger over a first angular arc and further rotating the handle so the second section of the locking member contacts the trigger over a second angular arc, the locking member rotating with an increased angular velocity through the second angular arc in comparison with the first angular arc;

moving the trigger manually from a first position in which the valve is closed to a second position in which the valve is open for dispensing the adhesive from the dispenser;

releasing the trigger to permit the trigger to return to the first position and thereby close the valve; and in response to releasing the trigger, automatically locking the trigger in the first position without manual assistance.

10. The method of claim 9 wherein automatically locking the trigger further comprises:

applying a spring bias to the trigger lock mechanism to move the locking member into a blocking relationship with the trigger that prevents movement of the trigger from the first position toward the second position.

11. The method of claim 10 wherein moving the trigger to cause the valve to open further comprises:

applying a manual force to the handle sufficient to overcome the spring bias and move the locking member out of the blocking relationship with the trigger such that the trigger is freed to move from the first position to the second position.

12. The method of claim 10 wherein applying the spring bias to the trigger lock mechanism further comprises:

twisting the coil of a torsion spring to apply the spring bias.

13. The method of claim 9 wherein unlocking the trigger includes permitting the trigger to move from the first position to the second position.

14. The method of claim 13 further comprising:

physically blocking movement of the trigger from the first position toward the second position with the locking member.

15. The method of claim 14 wherein unlocking the trigger further comprises:

applying a manual force to the handle sufficient to move the locking member to remove the physical blocking of the movement of the trigger and release the trigger to move from the first position to the second position.

16. The method of claim 9 wherein the valve includes a valve element movable by the trigger relative to a valve seat in a fluid passage for the adhesive, and moving the trigger from the first position in which the valve is closed to the second position in which the valve is open further comprises:

moving the valve element relative to the valve seat to separate the valve element is separated from the valve seat and open the fluid passage for dispensing the adhesive from the dispenser.

17. The method of claim 16 wherein releasing the trigger to close the valve further comprises:

moving the valve element relative to the valve seat to contact the valve element with the valve seat and close the fluid passage to discontinue the dispensing of the adhesive from the dispenser.

18. A method of dispensing an adhesive from the self-locking handheld dispenser of claim 1, the method comprising:

moving the trigger from a first position in which the valve is closed to a second position in which the valve is opened for dispensing the adhesive;

releasing the trigger to permit the trigger to return to the first position and thereby close the valve; and in response to releasing the trigger, automatically locking the trigger in the first position without manual assistance.

* * * * *

UNITED STATES PATENT AND TRADEMARK OFFICE

CERTIFICATE OF CORRECTION

PATENT NO. : 8,225,964 B2
APPLICATION NO. : 12/481231
DATED : July 24, 2012
INVENTOR(S) : Justin A. Clark It is certified that error appears in the above-identified patent and that said Letters Patent is hereby corrected as shown below:

At column 2, line number 31, after “is” insert --a--.

At column 5, line number 47, change “opening” to --opened--.

At column 6, line number 48, change “is” to --are--.

At column 8, line number 10, change “applicants” to --applicant-- and at line number 17, change “applicants’” to --applicant’s--.

In the Claims:

At column 10, claim number 16, line number 41, after “element”, delete “is separated”.

Signed and Sealed this
Eighteenth Day of September, 2012

David J. Kappos

David J. Kappos
*Director of the United States Patent and Trademark Office*